US005586835A

United States Patent [19]

Fair

[11] Patent Number: 5,586,835

[45] Date of Patent: Dec. 24, 1996

[54] SHORE EROSION CONTROL STRUCTURES

[76] Inventor: Samuel S. Fair, 599 Linwood Beach Rd., Linwood, Mich. 48634

[21] Appl. No.: 393,179

[22] Filed: Feb. 23, 1995

[51] Int. Cl.[6] ..... E02B 3/04

[52] U.S. Cl. ..... 405/30; 405/33

[58] Field of Search ..... 405/15, 21, 30, 405/31, 33, 35, 25; 52/606, 603, 604, 607, 612

[56] References Cited

U.S. PATENT DOCUMENTS

| | | | |
|---|---|---|---|
| 3,894,397 | 7/1975 | Fair . | |
| 4,073,111 | 2/1978 | Warren | 52/603 X |
| 4,073,145 | 2/1978 | Fair . | |
| 4,431,337 | 2/1984 | Iwasa | 405/30 |
| 4,479,740 | 10/1984 | Schaaf et al. | 405/30 |
| 5,074,707 | 12/1991 | Greene | 405/30 X |
| 5,120,156 | 6/1992 | Rauch | 405/30 X |

FOREIGN PATENT DOCUMENTS

| | | | |
|---|---|---|---|
| 1290226 | 3/1962 | France | 405/30 |
| 58310 | 8/1958 | Italy | 405/21 |
| 276113 | 12/1987 | Japan | 405/31 |
| 224907 | 10/1991 | Japan | 405/31 |
| 41934 | 2/1994 | Japan | 405/21 |

OTHER PUBLICATIONS

"T-shaped Wall Traps Sand to Build Beaches", Popular Mechanics, p. 62 (Jun. 1960).

*Primary Examiner*—James A. Lisehora
*Attorney, Agent, or Firm*—Learman & McCulloch

[57] ABSTRACT

Shore erosion control structure has a plurality of block members laid on a beach along a shoreline to form a wall having a plurality of parallel rows and vertical courses. Each of the block members has substantially horizontal, seaward facing openings within which are spaced apart baffles. The baffles are removably accommodated in the openings so as to be adjustable and provide tortuous passages through the wall through which water and entrained sand may flow. Water containing entrained sand flowing through the tortuous passages has its energy dissipated so as to enable the entrained sand to be deposited at the landward and seaward sides of the wall, as well as in the openings through the block members, thereby preventing the erosion of the beach and, in many cases, enabling restoration of beaches that have been eroded.

26 Claims, 5 Drawing Sheets

41
6
42
48
6

41
46
44
45
42
43
44

40

39

38

44
42
45
48

SHORE EROSION CONTROL STRUCTURES

This invention relates to a wall adapted to be constructed along a shoreline for the purpose of combatting beach erosion.

BACKGROUND OF THE INVENTION

Beach erosion by wave action is a common occurrence along the shores of large bodies of water where persistent wave action occurs. Various proposals have been made heretofore for combatting such erosion. The most effective control structures appear to be those corresponding to the disclosures of U.S. Pat. Nos. 3,387,458 and 4,073,145. The structures disclosed in those patents comprise walls made of concrete blocks having openings therein which are arranged in such manner that the openings are substantially horizontal and face seaward and landward. Alternate rows of such block have their openings staggered so that such openings form tortuous passages through which water and entrained sand may pass in response to the flow of incoming and outgoing waves through such openings. The tortuous nature of the passages through the blocks forming the wall causes the energy of the waves to be dissipated, thereby promoting the deposit of sand on both the landward and seaward sides of the wall, as well as in the passages themselves.

The erosion control structure disclosed herein constitutes an improvement on the structures disclosed in the aforementioned patents.

SUMMARY OF THE INVENTION

A shore erosion control wall is composed of a plurality of block members laid end to end on a beach to form an elongate row substantially parallel to the shoreline. Preferably, there are sufficient block members to provide a plurality of parallel rows and a plurality of vertical courses. The wall is composed of bottom block members, intermediate block members, and top block members. All of the bottom block members may be the same, all of the intermediate block members may be the same, and all of the top block members may be the same.

Each of the bottom and intermediate block members has top and bottom panels, spaced uprights defining openings, and slots for the removable accommodation of baffles in such openings. The block members of adjacent rows may be staggered, if desired, but the removability of the baffles enables the baffles of adjacent block members to be staggered, thereby providing tortuous passages in the wall through which water and entrained sand may pass. The block members are of such size and weight as to be relatively impervious to normal wave action and can withstand more severe wave action. However, to enable the block members of a wall to withstand extremely severe wave action, the adjacent block members are secured to one another by nesting components and locking pins.

A wall constructed in accordance with the invention may be several hundred or more feet in length and, at each end of the wall, an auxiliary wall is formed to minimize the entry of severe wave action to the landward side of the wall during storms.

THE DRAWINGS

Apparatus constructed in accordance with the preferred embodiment of the invention is disclosed in the accompanying drawings, wherein.

DETAILED DESCRIPTION

Figure 10:
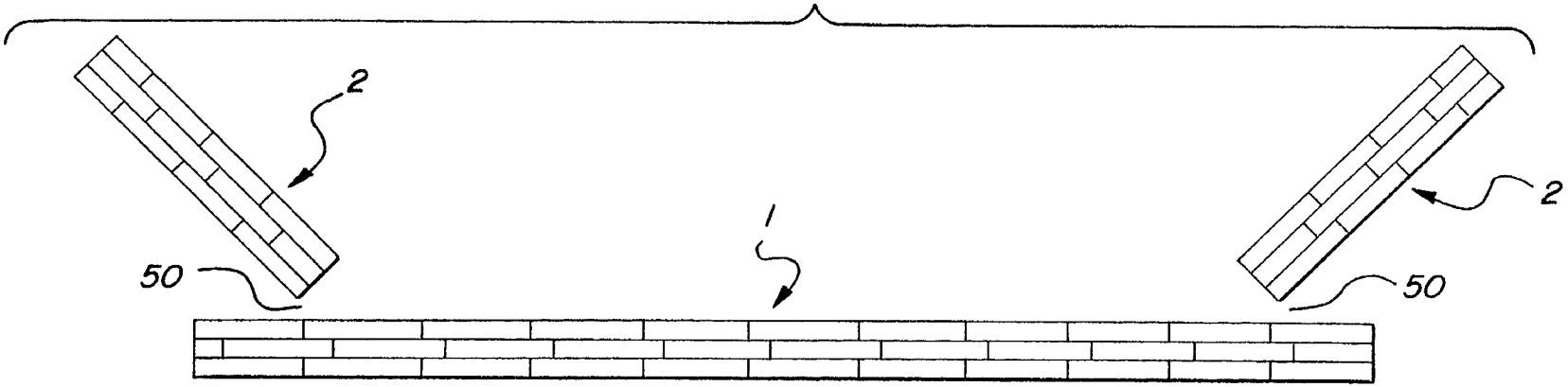
FIG. 10 is a diagrammatic top plan view showing a sea wall constructed in accordance with the invention and having adjacent its opposite ends obliquely extending auxiliary wall sections.

FIG. 10 discloses block members constructed in accordance with the invention arranged in longitudinally extending, parallel rows to form a seawall 1 substantially parallel to a shoreline and at adjacent opposite ends of which are auxiliary walls 2 which extend obliquely toward the shore. The block members from which the walls 1 and 2 are formed are composed of multiple components formed of marine grade concrete, and the configuration of each block member depends upon whether such block member forms the bottom, intermediate, or upper course of the wall.

Figure 1:
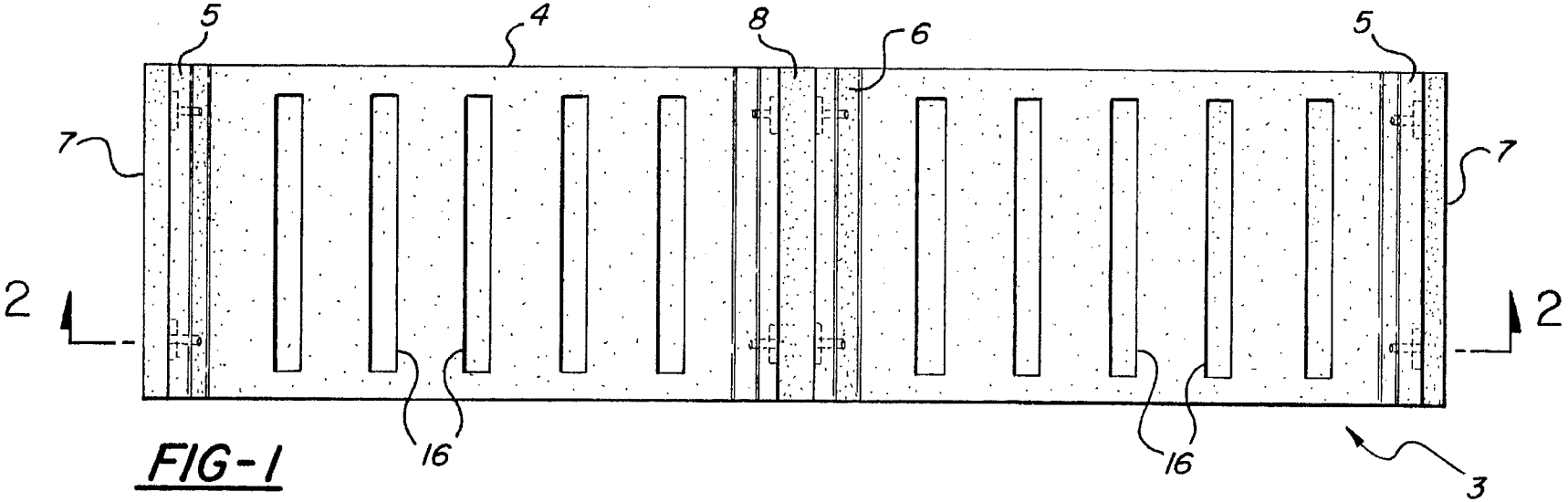
FIG. 1 is a top plan view of a block member that is adapted to form the base or bottom of a wall.
Figure 2:
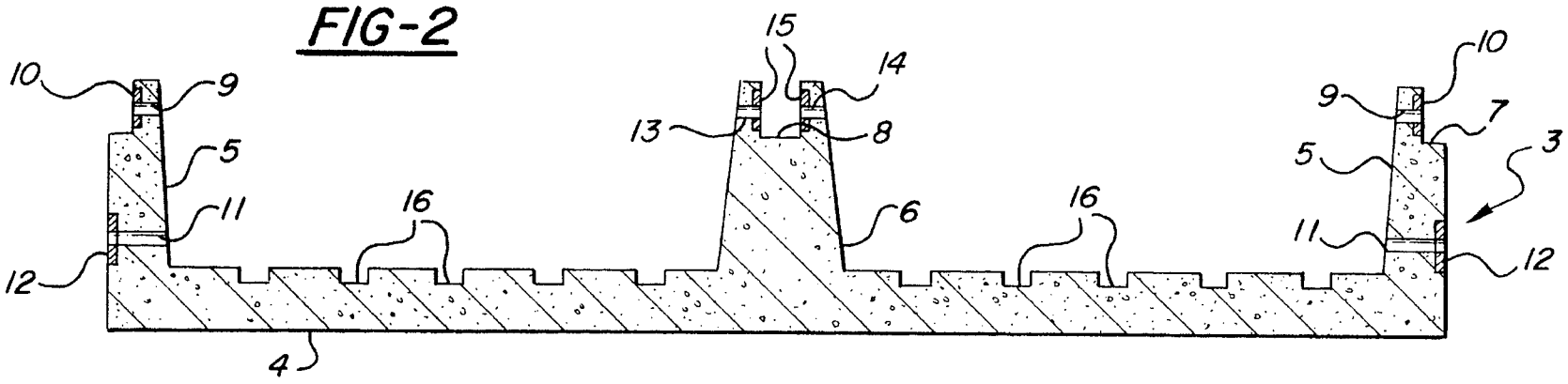
FIG. 2 is a sectional view taken on the line 2—2 of FIG. 1.

A bottom block member is designated generally by the reference character 3 and is best disclosed in FIGS. 1 and 2. The block member 3 comprises a bottom panel 4 from which a plurality of spaced apart uprights 5 and 6 extend. The uprights 5 are at opposite ends of the panel 4, whereas the upright 6 is approximately midway between the uprights 5. Each of the end uprights has an outwardly facing notch 7 and the intermediate upright 6 has an upwardly open groove 8. At the upper end of each of the uprights 5 is a plurality of horizontal openings 9 encircled by a metallic washer 10 that is molded in place during the formation of the block 3. Each upright 5 also has adjacent its lower end another opening 11 that also is encircled by an embedded washer 12.

The upright 6 has aligned, horizontal openings 13 and 14 on opposite sides of the slot 8 and at the inner end of each opening is an embedded washer 15.

In the upper surface of the bottom panel 4 is a plurality of transversely extending, parallel, spaced apart grooves 16. Preferably, the grooves terminate short of the front and rear edges of the bottom panel, as is best shown in FIG. 1. The purpose of this construction will be explained subsequently.

In the construction of the wall 1, a plurality of bottom block members 3 are laid end to end on a beach at or adjacent the calm water or mean low tide line so as to form a row extending generally parallel to the shoreline. As is shown in FIG. 10, there preferably are a plurality of parallel rows of block members arranged side by side. Although only three rows of block members are shown in FIG. 10, additional rows may be provided, if desired.

Following the laying of the block members 3 in one or more rows, or concurrently therewith, a plurality of rectangular baffles 17 are fitted into selected ones of the grooves 16. Each baffle preferably is formed of marine grade concrete and is of such width as snugly to be accommodated in any of the grooves 16. The length of each baffle may be coextensive with the length of the grooves 16 or, if preferred, the baffle may be shorter than the length of the grooves 16. In any event, the height of each baffle preferably is such that, when it is accommodated in a groove, its upper edge will be coplaner with the upper edges of the uprights 5 and 6. The baffles of adjacent rows are staggered so as to provide tortuous passages through the adjacent rows of block members.

The length of each block member 3 may vary, but it is preferred to construct it of such length and width and of such weight as to resist displacement by normal wave action. Block members having a length of 8 feet, a width of 2 feet, and a height of 1.5 feet, have proven to be satisfactory.

Following the placing of the bottom block members in rows, and the arrangement of the baffles 17 in selected ones of the grooves 16, a second course of block members may be assembled atop the lower course. Each upper course includes an intermediate block member 20 having a bottom panel 21 from which extend uprights 22 and 23 corresponding to the uprights 5 and 6, respectively. The upper surface of the panel 21 is provided with parallel, spaced apart grooves 24 which correspond to the grooves 16. Each upright 22 has a notch 25 and the upright 23 has a slot 26, the notches and slot corresponding to the notches 7 and slots 8, respectively. Each of the uprights also includes openings 27, 28, and 29 and washers 30 and 31.

One difference between the intermediate member 20 and the bottom member 3 is that the intermediate member has three downwardly extending projections, two of which, 32, are at opposite ends and the other of which, 33, is at the center. The extensions 32 nest with the notches 7 and are provided with openings 34 for the accommodation of pins which extend into the openings 9 of the lower block member 3. The openings 34 also are encircled by embedded washers 35. The central projection 33 is of such size as to be accommodated in the slot 26 of the slot 8 of the lower upright 6 and includes openings 36 encircled by washers 37 for the accommodation of pins which extend not only through the openings 36, but also the openings 13 and 14 of the lower block member.

As many of the intermediate block members 20 as may be desirable can be utilized so as to construct a wall of several courses high. In each case, the panel 21 of each block member 20 forms not only the bottom panel of such block member, but also the upper panel of the lower block member 3 or 20 and rests upon the baffles to secure the latter in place. In each instance, the projections 32 and 33 may be accommodated snugly in the notches 7 and 8 of the lower block member 3 or in the notches 25 and the groove 26 of the adjacent lower block member 20.

The lowest intermediate block member 20 may be secured to the bottom block member 3 by headed pins 38 which may pass through aligned openings 9 and 27 and by pins 39 which pass through aligned openings 13, 14, 28 and 29. If desired, U-shaped retainers 40 may be utilized to couple blocks in adjacent rows to one another by placing one leg of a retainer 40 in an opening 27 closer to the adjacent row and the other leg of the retainer 40 in the closer opening of the adjacent row. Alternatively, the adjacent rows could be secured to one another simply by utilizing the retainers 40 and coupling the uprights 6 and 23 of adjacent rows to one another. The use of the pins and retainers rigidifies the structure against severe wave action.

The erosion control structure includes an upper block member 41 having smooth upper and lower surfaces 42 and 43, respectively, and terminating at its opposite ends in downwardly extending projections 44 which are adapted to be accommodated in the notches 7 or 25 of the adjacent lower block member. Each projection 44 has a pair of openings 45 encircled by metallic washers 46 for the accommodation of pins 38. Preferably, the seaward facing edge of the block member 41 is beveled as in 48 so as to promote the flow of water over the upper block member.

When an upper block member 41 is assembled atop a bottom block member 3 or an intermediate block member 20, the member 41 forms the top panel of the adjacent lower block member and bears upon the lower baffles.

Figure 9:
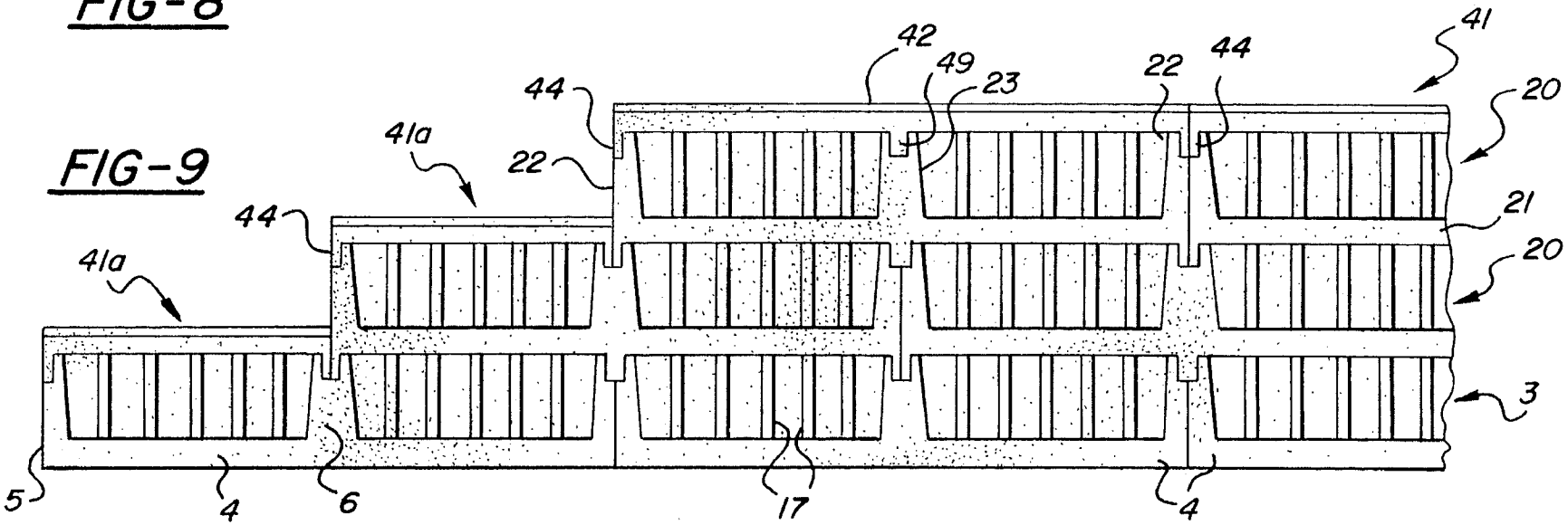
FIG. 9 is a fragmentary front elevational view of the wall shown in FIG. 8.

Depending upon the length of a top block member 41, it will have only the end projections 44 or, as is shown in FIG. 9, an intermediate projection 49 which is adapted to be accommodated in the slot 8 or 26 of a block member 3 or 20, respectively. The projection 49 has openings corresponding to the opening 36 in the projection 33 of the intermediate block member 20.

Figure 11:
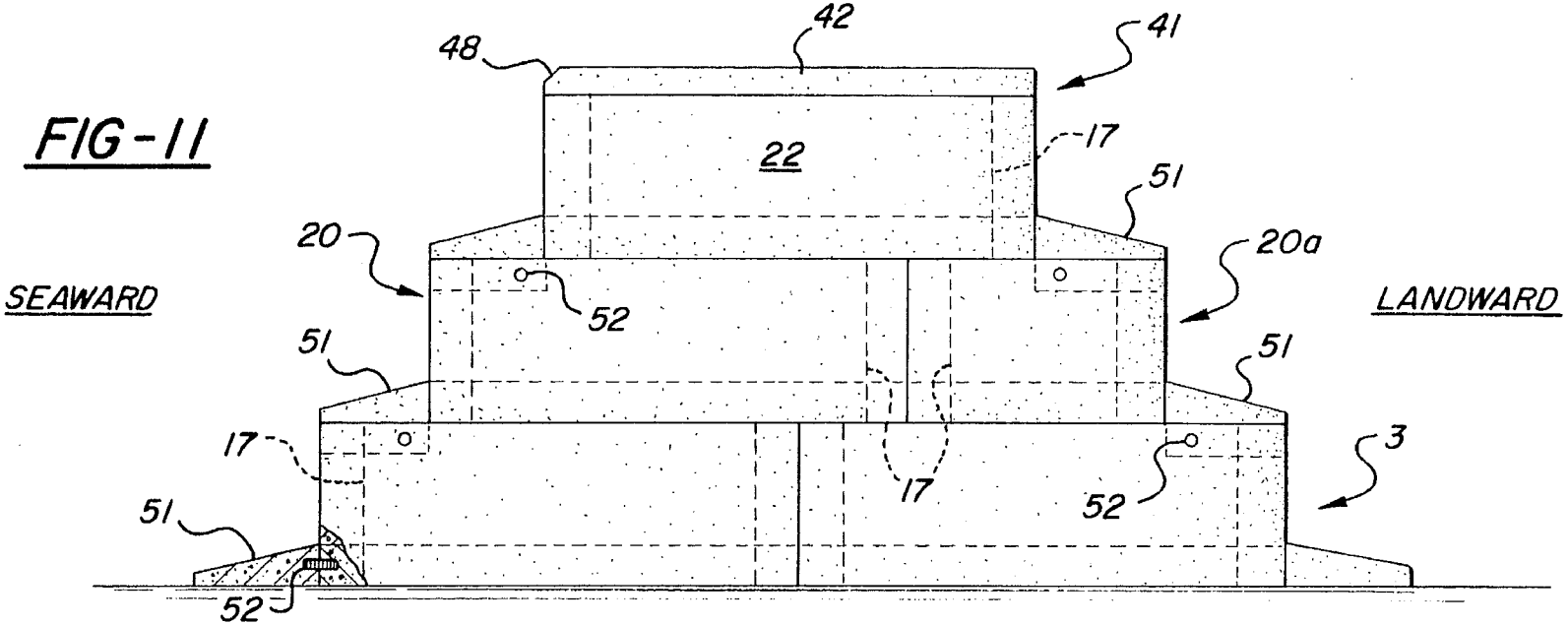
FIG. 11 is an end elevational view, partly in section, of a typical sea wall.

The block members from which the walls 1 and 2 are formed may be of uniform length and width or of varying length and width. FIG. 9 shows upper block members 41 and **41*a* of different lengths and FIG. 11 shows intermediate block members 20 and 20*a*** of different width. The length and width of the block members selected for use in erecting the sea wall will depend upon the desired length, width, and height of such wall.

The opposite ends of the wall 1 may be vertical, or stair-stepped as shown in FIG. 9. The seaward and landward sides of the wall may be vertical, or stepped as shown in FIG. 11.

Each of the auxiliary walls 2 is constructed in the same manner as the wall 1 and from corresponding block members. When the bottom, intermediate, and top block members are assembled, the respective bottom and top panels and the uprights form openings which are substantially horizontal and face seaward. The baffles 17 will define tortuous passages through each wall and through which water and entrained sand may flow.

The particular angle at which the auxiliary walls 2 are placed with respect to the shoreline and the main wall 1 also will vary, depending upon such considerations as the contour of the shore, the littoral drift and other factors, but in any event it is preferred to provide a space between each auxiliary wall 2 and the main wall so that turtles and other non-flying sea life may have access to the beach.

When the sea wall is in place, it will be in a position to intercept waves breaking onto the beach. As the waves impinge on the wall they tend to scour sand from beneath the seaward side of the wall. This can be overcome to a large extent by providing an upwardly inclined extension or toe 51 at the base of and along the length of the seaward-most block members, and such toe may be secured to the bottom block members by pins 52. Similar toe members 51 may be secured atop the bottom and intermediate block member 3 and 20, and Such toe members may be secured by pins 52. The toe members 51 overlie the exposed ends of the baffles in those instances in which the upper courses of block members are stepped.

Figure 3:
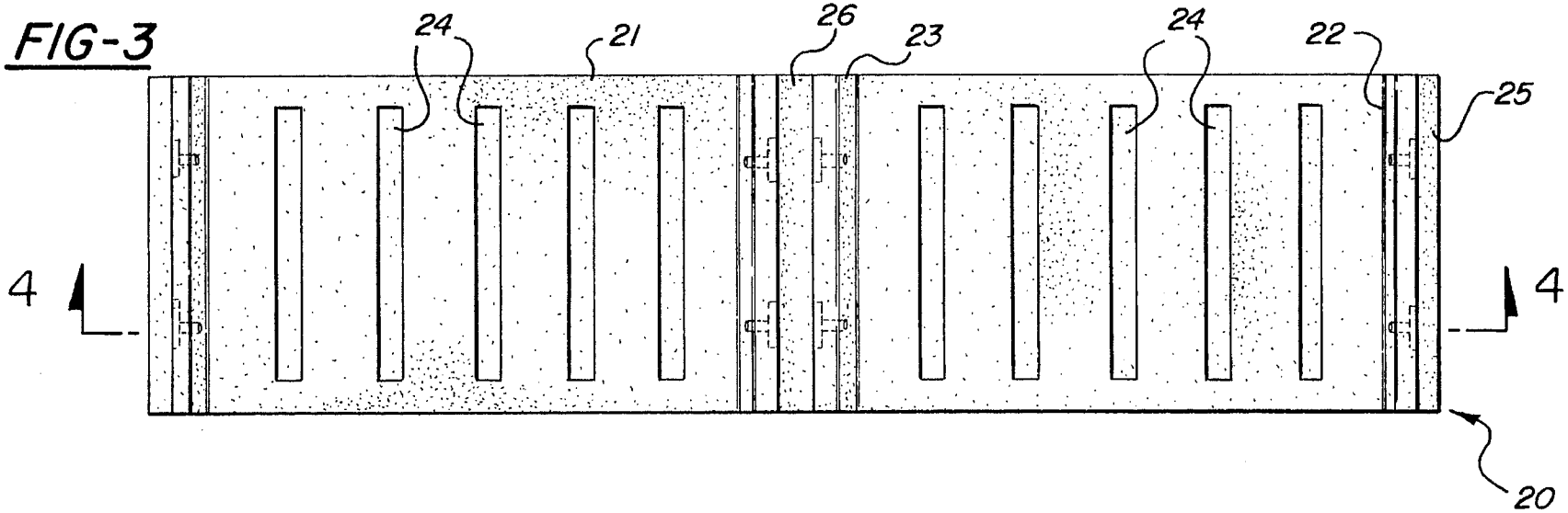
FIG. 3 is a top plan view of a block member that is adapted to form an upper course of the wall.
Figure 4:
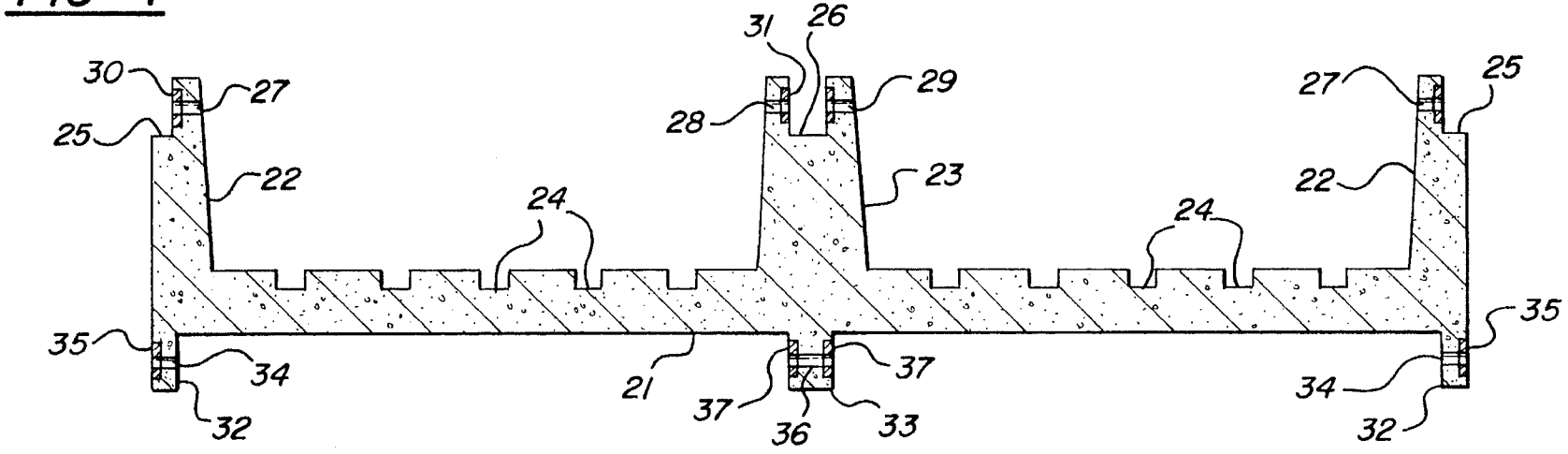
FIG. 4 is a sectional view taken on the line 4—4 of FIG. 3.
Figures 5, 6, 7, 12, 13, 14:
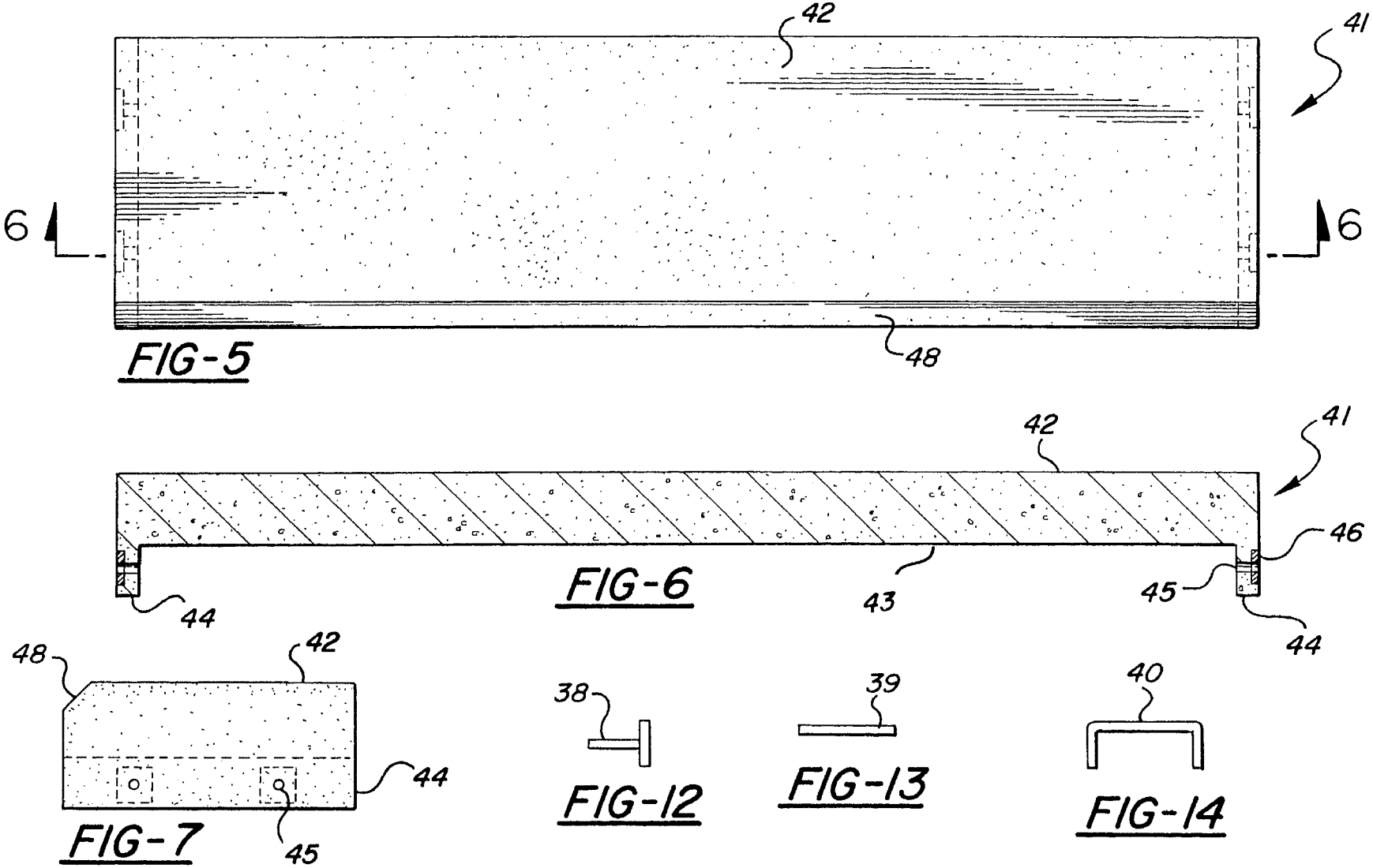
FIG. 5 is a top plan view of a block member that is adapted to form the upper-most part of a wall.
FIG. 6 is a sectional view taken on the line 6—6 of FIG. 5.
FIG. 7 is an end elevational view of the block member shown in FIG. 5.
FIGS. 12–14 are elevational views of fasteners which may be used with the blocks disclosed in the other figures.
Figure 8:
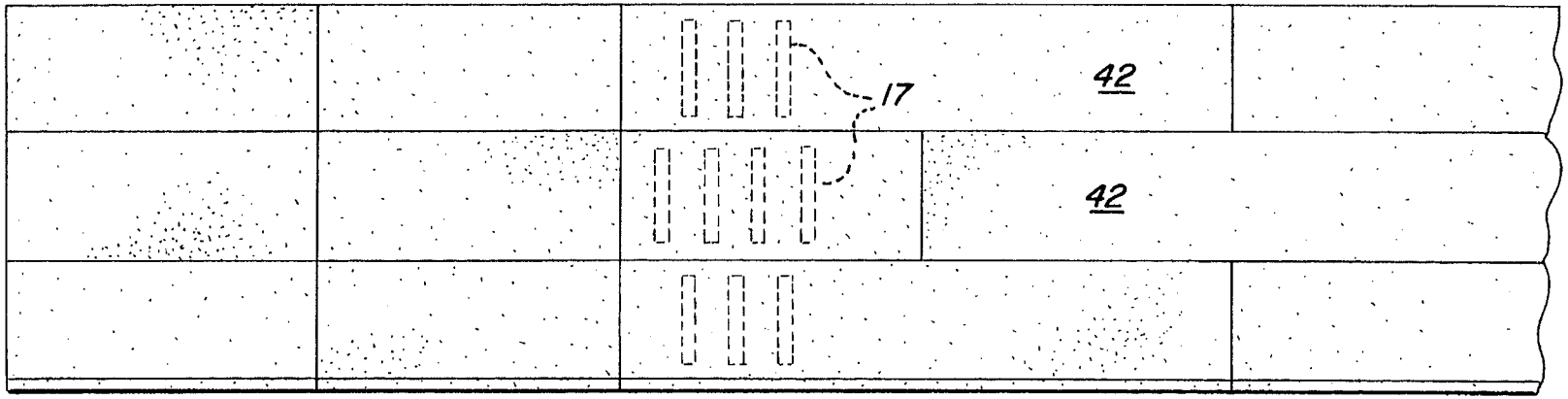
FIG. 8 is a fragmentary top plan view illustrating three adjacent rows of block members which together form a part of a sea wall.

Only rarely do waves approaching a beach break perpendicularly to the shoreline. More often, the waves approach the beach obliquely. If the wall is substantially parallel to the shoreline, then the incoming waves may have a tendency to traverse the length of the wall, rather than enter the openings formed by the panels and uprights of the block members. This tendency is overcome to a large extent by recessing the seaward ends of the baffles 17 inwardly from the front edges of the sides of the wall, as is best shown in FIGS. 1, 3, and 8. Preferably the grooves 16 are spaced from both the seaward and landward sides of the block members, thereby preventing endwise movement of the baffles out of their respective openings and enabling either side of the block members to be the seaward side.

As waves encounter the wall, they will traverse the passages formed by the baffles 17 and expend a considerable part of their energy. The same result will be achieved as the waves recede. Sand entrained in the water of the incoming and ebbing waves will be deposited on the landward and seaward sides of the wall, as well as in the passages themselves, thereby rebuilding the beach. In time the wall will be completely covered by the sand reclaimed from the waves.

The disclosed embodiment represents the presently preferred form of the invention, but is intended to be illustrative rather than definitive thereof. The invention is defined in the claims.

I claim:

1. A soil erosion control structure comprising a plurality of parallel rows of block members arranged end to end forming a primary wall extending along a shoreline, each of said block members having a top panel and a bottom panel spaced from one another by spaced apart uprights to form at least one seaward facing, substantially horizontal opening between said panels and said uprights; and a plurality of baffles removably accommodated in said opening and extending substantially parallel to said uprights, said baffles being spaced from one another to form passages extending through each of said block members.

2. The structure according to claim 1 wherein the baffles are of less width than that of the opening.

3. The structure according to claim 1 wherein each of said block members has a seaward side, each of said baffles terminating in a position short of said seaward side.

4. The structure according to claim 3 including means for preventing movement of said baffles beyond said position toward said seaward side.

5. The structure according to claim 1 wherein one of said parallel rows is a row of seaward-most block members and wherein each of the seaward-most block members has an extension of its bottom panel which projects seaward of such block member.

6. The structure according to claim 1 wherein each of said top panels is separable from the uprights and includes means for coupling said top panels to said uprights.

7. The structure according to claim 1 wherein the baffles of adjacent rows of said block members are staggered.

8. The structure according to claim 1 including means for coupling the block members of adjacent rows to one another.

9. The structure of claim 1 including a plurality of courses of said block members.

10. The structure of claim 9 including means for connecting the block members of adjacent courses to one another.

11. The structure of claim 9 including a lower course and an adjacent upper course wherein the top panel of each block member of the lower course is formed by the bottom panel of the block member of the adjacent upper course.

12. The structure of claim 11 wherein the uprights of the block member of the lower course of block members nest with the bottom panels of the block members of the adjacent upper course of block members.

13. The structure of claim 11 wherein the uprights of the lower course of block members are notched and wherein the bottom panels of the adjacent upper course of block members have extensions accommodated in said notches.

14. The structure according to claim 13 including pins extending through openings formed in said extensions and said uprights.

15. The structure according to claim 1 including a plurality of additional rows of said block members at least at one end of said wall forming an auxiliary wall extending in a direction shoreward from said primary wall.

16. The structure according to claim 15 including an auxiliary wall adjacent each end of said primary wall.

17. A block member for use in constructing a shore erosion control wall along a shoreline, said block member comprising a top panel and a bottom panel connected by spaced apart uprights to form at least one opening defined by said panels and said uprights; and a plurality of spaced apart baffles removably accommodated in said opening and supported by said bottom panel and forming a plurality of passages extending transversely through said block member and substantially parallel to said uprights.

18. The block member according to claim 17 wherein at least one of said panels has a plurality of spaced apart substantially parallel grooves in selected ones of which said baffles are accommodated.

19. The block member according to claim 18 wherein said grooves terminate short of opposite sides of said one of said panels.

20. The block member according to claim 18 wherein said one of said panels is said bottom panel.

21. The block member according to claim 17 wherein said top panel is separable from said bottom panel.

22. The block member according to claim 21 wherein said uprights and said top panel nest with one another.

23. The block member according to claim 17 wherein three uprights extend between said bottom panel and said top panel and provide support for said top panel, said uprights forming two openings, each of said uprights and said top panel having cooperating tongues and grooves in nested relationship for preventing relative movement of said panels.

24. The block member according to claim 17 wherein said top panel has a plurality of substantially parallel, spaced apart uprights for supporting a second top panel to form a second opening at a level above that of said one opening, said second top panel having a plurality of substantially parallel, spaced apart grooves for the removable accommodation of a second plurality of said baffles.

25. The block member according to claim 17 wherein said top panel has a smooth, upper surface.

26. A block member for use in constructing a shore erosion control wall along a shoreline, said block member comprising a top panel and bottom panel connected by spaced apart uprights to form at least one opening defined by said panels and said uprights and extending entirely through said block member, said bottom panel having therein a plurality of spaced apart slots substantially parallel to said uprights; and a plurality of baffles removably accommodated in selected ones of said slots and forming a plurality of spaced apart passages each of which extends entirely through said block member and substantially parallel to said uprights, each of said slots being of such width as to accommodate any one of said baffles thereby enabling each of said passages to have a selected width.

* * * * *